US006471598B2

(12) United States Patent
Takase

(10) Patent No.: US 6,471,598 B2
(45) Date of Patent: Oct. 29, 2002

(54) GOLF SWING TRAINING DEVICE

(76) Inventor: Shinichi Takase, 6-1-5, Kumochibashi-dori, Chuo-ku, Kobe-shi, Hyogo (JP)

( * ) Notice: Subject to any disclaimer, the term of this patent is extended or adjusted under 35 U.S.C. 154(b) by 0 days.

(21) Appl. No.: 09/749,007

(22) Filed: Dec. 27, 2000

(65) Prior Publication Data

US 2001/0021674 A1 Sep. 13, 2001

(30) Foreign Application Priority Data

Mar. 10, 2000 (JP) ..... 2000-066455

(51) Int. Cl.[7] ..... A63B 57/00; A63B 69/36
(52) U.S. Cl. ..... 473/212; 473/227; 473/207
(58) Field of Search ..... 473/206–208, 473/212–215, 227–229, 266, 274–276, 294–299, 277, 219, 450, 458, 464

(56) References Cited

U.S. PATENT DOCUMENTS

| | | | | |
|---|---|---|---|---|
| 4,023,812 A | * | 5/1977 | Lorang | 473/227 |
| 4,399,994 A | * | 8/1983 | Hourihan | 473/227 |
| 5,022,656 A | | 6/1991 | Tiller | |
| 5,074,565 A | | 12/1991 | Tucker | |
| 5,174,575 A | * | 12/1992 | Leith et al. | 473/227 |
| 5,248,146 A | | 9/1993 | Viets et al. | |
| 5,342,055 A | | 8/1994 | Diley | |
| 5,465,971 A | | 11/1995 | Tischler | |
| 5,520,392 A | | 5/1996 | Foresi et al. | |
| 5,904,624 A | | 5/1999 | Martinez | |
| 6,004,221 A | | 12/1999 | Thornhill | |

FOREIGN PATENT DOCUMENTS

| | | |
|---|---|---|
| JP | 5-177023 | 7/1993 |
| JP | 10-85375 | 4/1996 |
| JP | 8-117376 | 5/1996 |

* cited by examiner

*Primary Examiner*—Paul T. Sewell
*Assistant Examiner*—Mitra Aryanpour
(74) *Attorney, Agent, or Firm*—Koda & Androlia

(57) ABSTRACT

A golf swing training device which is designed while attaching importance to natural physical motion of a golfer and which assures that the club draws a straight trajectory. The training device has an extensible restraining rod whose top end is attached to one arm of the golfer. The bottom end of the training device is attached to a side of the head of the shaft of a golf club. The restraining rod can be stretched and compressed and thus the length can be adjusted. A holding belt is loosely mounted to a side of the restraining rod that is attached to the golfer's arm. A flexible coupling forms the end of the restraining rod that is mounted to the club shaft.

1 Claim, 3 Drawing Sheets

GOLF SWING TRAINING DEVICE

BACKGROUND OF THE INVENTION

1. Field of the Invention

The present invention relates to a training device of golf swing and, more particularly, to a training device which is made in view of the fact that the golfer's arms must move integrally with the golf club. It makes a shoulder swing and which holds the club and the golfer's arms integral when a sequence of motions starting with a takeback and ending with a follow-through is performed, so that the golfer memorizes the feeling of the swing.

2. Description of the Prior Art

Various proposals have been made to cause the moving club face to draw a linear trajectory along the direction of impact as described, for example, in U.S. Pat. Nos. 5,022,656, 5,074,565, 5,248,146, 5,342,055, 5,465,971, 5,520,392, 5,904,624, and 6,004,221. Also, a training device having two parallel guides forming a gap therebetween to cause the face of a golf club to move along the gap has been proposed in Japanese Patent Laid-Open No. 177023/1993. Another training device disclosed in Japanese Patent Laid-Open No. 117376/1996 has an arm for holding a golf club, and this arm is mounted to a rotating machine installed in front of a golfer. During practice, the golfer is guided by the arm. A further training device disclosed in Japanese Patent Laid-Open No. 85375/1998 is equipped with an arm support installed ahead of a golfer. A swinging arm is pivoted to the arm support so as to be capable of moving back and forth. A putter is attached to the swinging arm.

SUMMARY OF THE INVENTION

Conventional training devices of this kind are large in size, and many of them are machine-oriented. That is, they do not permit natural movement of golfers or make it difficult for the moving club face to draw a linear trajectory.

Accordingly, the present inventor has discussed a simple training device which is designed while attaching importance to natural physical movement of a golfer and which assures a moving club face to draw a linear trajectory. In particular, the golfer wears the training device, which causes a sequence of motions starting with a takeback and ending with a follow-through to be performed such that the arms and shoulders of golfer move integrally with the club.

As a result of the above-described discussion, the present inventor has made a training device for golf swing equipped with an extensible restraining rod whose top end is attached to one arm of a golfer and whose bottom end is attached to a side of the head of a golf club. The extensible restraining rod can be stretched and compressed and thus the length can be adjusted. A holding belt for attachment to the arm is loosely mounted to the rod. The end of the rod that is attached to the club shaft is made of a flexible coupling.

Preferably, the means for loosely mounting the holding-belt attached to the golfer's arm comprises a slot formed in the restraining rod near its top end and a metal fixture inserted in the slot. The holding-belt attached to the arm is mounted to the metal fixture. This means permits only rectilinear movement. The flexible coupling forming the end of the rod attached to the club shaft is preferably movable vertically and horizontally slightly.

DESCRIPTION OF THE PREFERRED EMBODIMENTS

Figure 1A:
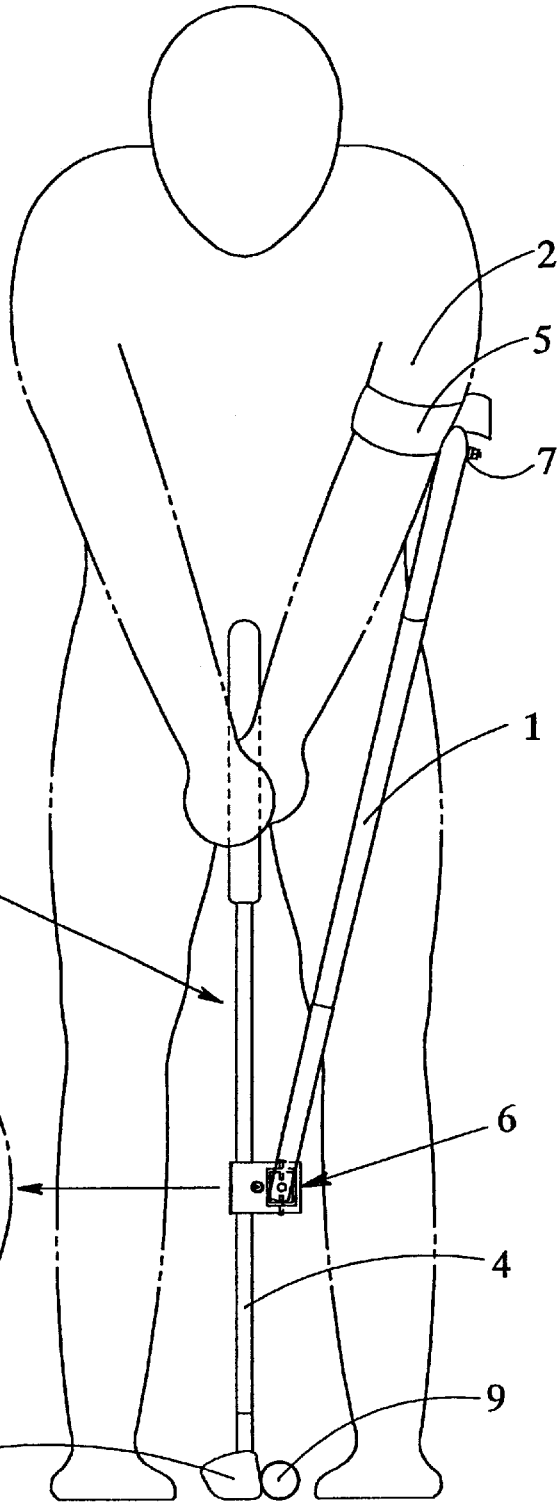
FIG. 1A is a front elevation of a golf swing training device in accordance with the present invention when the twining device is in use and FIG. 1B is an enlarged portion of FIG. 1A.
Figure 1B:
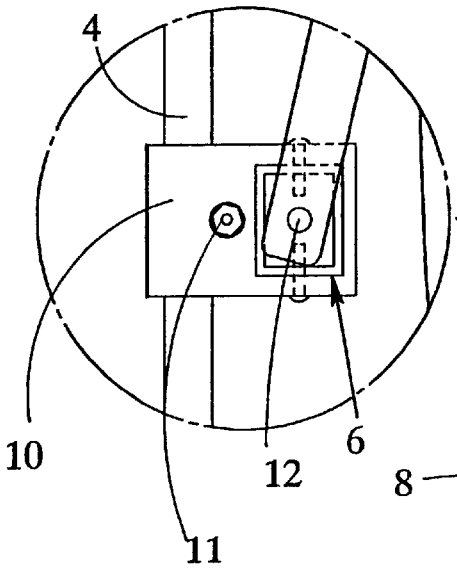

FIGS. 1A, 1B, 2A and 2B, there are shown a golf swing training device in accordance with the present invention and a golfer who uses the training device together with a golf club 3. This swing training device has an extensible restraining rod 1 which can be stretched and compressed if necessary and hence its length can be adjusted. This rod 1 can be attached at its top end to one arm 2 of the golfer. The bottom end of the rod 1 is mounted to a head side of the shaft 4 of the club 3. This restraining rod 1 consists of movable plural tubular portions and can be stretched and compressed The movable tubular portions of the rod 1 can be made stationary such that the rod 1 is fixed at a desired length. A holding belt 5 is loosely mounted to a side of the rod 1 that is to be attached to the golfer's arm. The end of the rod 1 to be mounted to the shaft 4 of the club 3 is coupled to the shaft 4 by a flexible coupling 6. A slot 7 is formed in the restraining rod 1 near its top end. Instead of using the slot in holding the training device, an expansion joint such as a spring coupling can be used to permit the restraining rod 1 to be stretched and compressed, whereby the length of the restraining rod 1 can be adjusted.

Figures 2A, 2B:
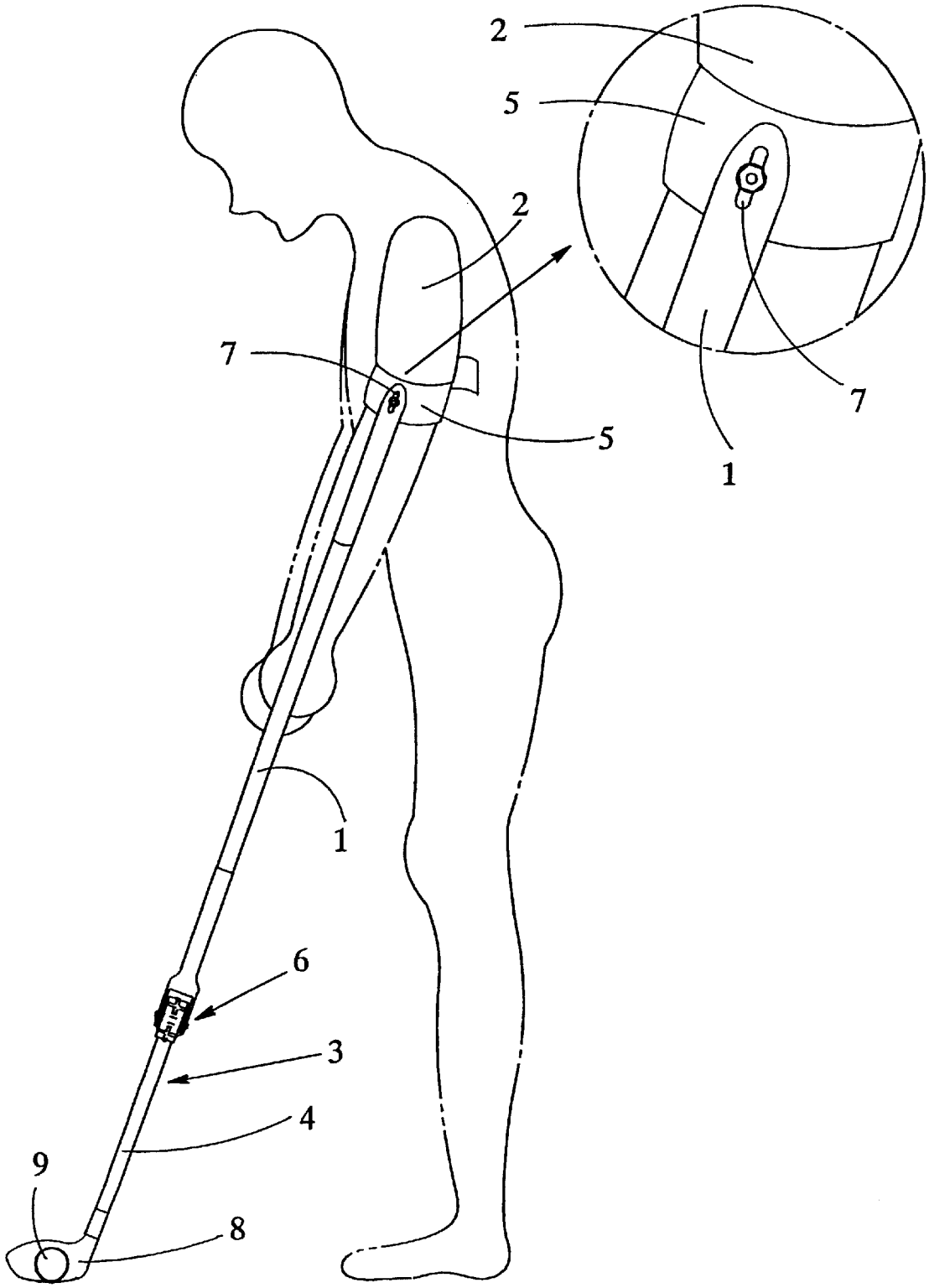
FIG. 2A is a side elevation of the golf swing training device shown in FIG. 1A when the training deice is in use and FIG. 2B is an enlarged portion of FIG. 2A.

The flexible coupling 5 permits the arm 2, the shaft 4 of the club 3, and the restraining rod 1 that are linked together to form a triangle when viewed from the front as the golfer's arm moves. The angle between the shaft 4 and the restraining rod 1 can be varied at will. As shown in FIGS. 2A and 23B the shaft 4 of the club 3 and the restraining rod 1 hold a constant relation at all times as viewed from a side and do not deviate from the direction of trajectory of the club 3, This assures that the direction of movement of the head 8 (which is shown to be a putter head but can also be an iron head, wooden head or other head) is coincident with the direction of an impact target. Consequently, the golfer can memorize the feeling that he/she strikes a ball 9 toward the target always. Since the height and the arm length differs according to the golfer, if the positions at which the training device is attached to the golfer's arm and to the shaft 4 of the club 3, respectively, are optimally adjusted before use, the swing can be corrected always.

The flexible coupling 6 is described in further detail. The flexible coupling 6 is shown enlarged in the insert of FIG. 1. To rotatably mount the restraining rod 1 to the shaft 4 of the club 3, a gripping bracket 10 grips the shaft 4 and is fixed with a screw 11. The restraining rod 1 is pivotally connected to the gripping bracket 10 via a pivotal hinge 12, thus forming the flexible coupling 6.

Figure 3:
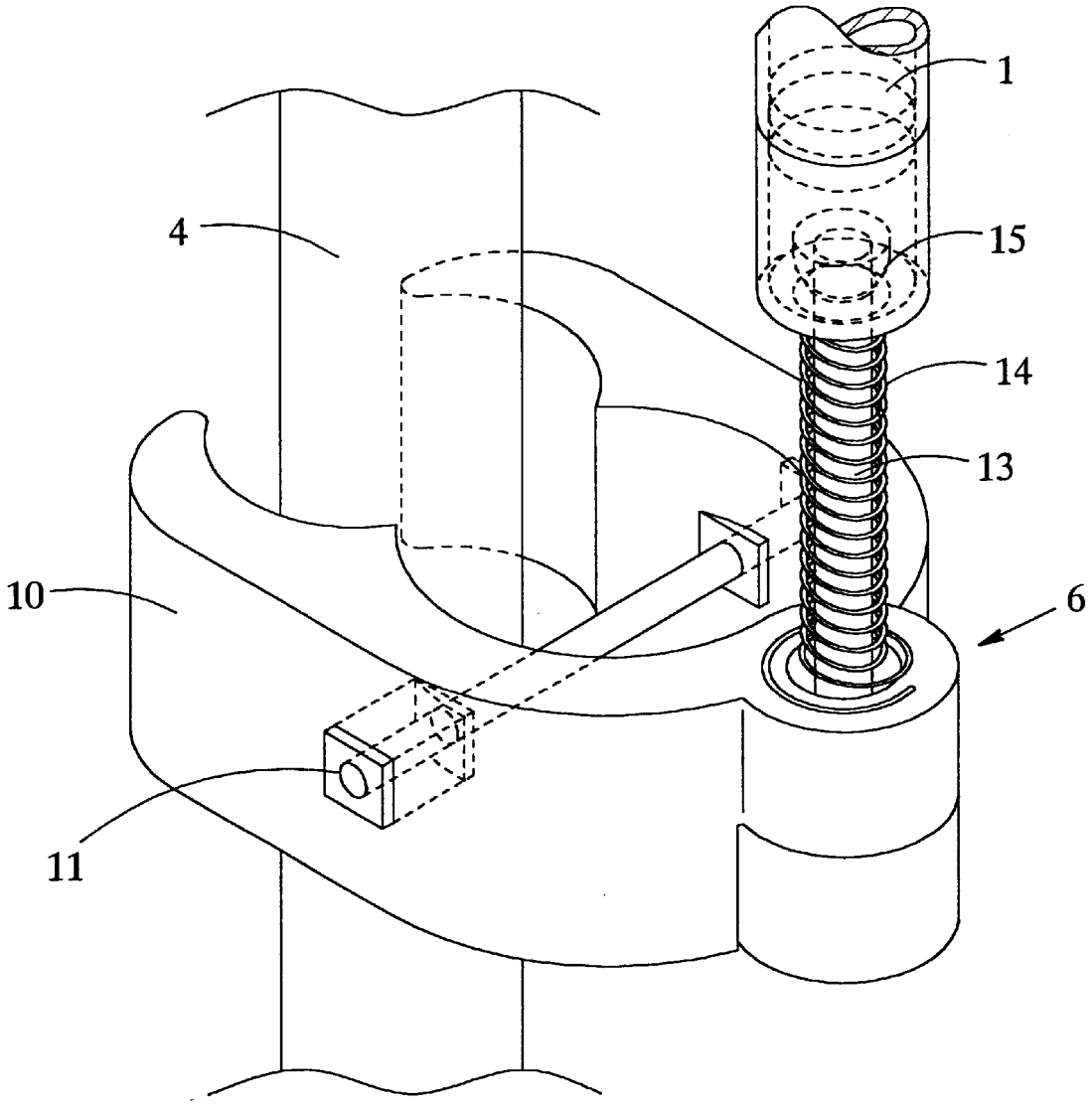
FIG. 3 is an enlarged perspective view of a flexible coupling portion of another golf swing training device in accordance with the invention.

FIG. 3 shows another example of the flexible coupling 6. The hinge that permits the gripping bracket 10 to be opened and closed is extended upward to form a joint rod 13 of the restraining rod 1. A spring 14 is mounted around the joint rod 13. The restraining rod 1 is connected to the top end of the joint rod 13 via a spherical joint 15. Since the spring exists under the spherical joint 15, the dynamic load can be adjusted by the strength of the spring 14.

As described thus far, the golf swing training device in accordance with the present invention permits a sequence of motions starting with a takeback and ending with a follow-through to be performed while urging golfer's arms and shoulder to move integrally with the golf club, regardless of the golfer's physical bodily shape and whether the golfer is right-handed or left-handed. Furthermore, the training device can be used with any golf club. In addition, the golfer can get a feeling of distance by hitting a ball with only one arm. Where the training device is worn on only one arm. The prior art of training devices had been unsuitable for outdoor use. On the hand, the golf swing training device in accordance with the present invention can be used outdoors, especially on golf courses while playing or for practices.

What is claimed is:

1. A golf swing training device comprising:

an extensible restraining rod wherein its top end is attached to an arm of a golfer holding a golf club comprising a shaft having a head, the restraining rod having a bottom end attached to a top portion of the shaft of the golf club positioned in the direction of an impact target, the restraining rod capable of being stretched and compressed and thus having an adjustable length;

a holding belt loosely mounted to a portion of the restraining rod that is attached to the arm of a golfer; and a flexible coupling positioned on an end of the restraining rod that is mounted to the shaft of the club; wherein said restraining rod comprises a slot formed in said restraining rod close to its top end and extending longitudinally from the restraining rod, the top end being attached to the arm of the golfer, a metal fixture inserted in said slot, and with said holding belt mounted to the metal fixture, whereby the direction of a swing made by a golfer is restricted to one direction; and said flexible coupling comprises a hinge that permits a gripping bracket to be opened and closed, thereby extending upwardly with to form a joint rod of said restraining rod, a spring is mounted around said joint rod, and a spherical joint is connected to said restraining rod at the top end of said joint rod, thereby permiting said restraining rod to move vertically and horizontally.

* * * * *